US008701956B2

(12) United States Patent
Takemura et al.

(10) Patent No.: US 8,701,956 B2
(45) Date of Patent: Apr. 22, 2014

(54) HAND-HELD TOOL, FASTENER RESIDUAL QUANTITY DETECTING MECHANISM, FASTENER RESIDUAL QUANTITY DETECTING METHOD, AND POWER SAVING METHOD

(75) Inventors: Hajime Takemura, Tokyo (JP); Hiroshi Tanaka, Tokyo (JP); Shuichi Ishii, Tokyo (JP); Kazuya Takeuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 148 days.

(21) Appl. No.: 12/863,352

(22) PCT Filed: Feb. 5, 2009

(86) PCT No.: PCT/JP2009/051997
§ 371 (c)(1),
(2), (4) Date: Jul. 16, 2010

(87) PCT Pub. No.: WO2009/099159
PCT Pub. Date: Aug. 13, 2009

(65) Prior Publication Data

US 2010/0294824 A1 Nov. 25, 2010

(30) Foreign Application Priority Data

Feb. 6, 2008 (JP) ..... P.2008-026991
Feb. 6, 2008 (JP) ..... P.2008-026992
Feb. 6, 2008 (JP) ..... P.2008-026993

(51) Int. Cl.
*B27F 7/13* (2006.01)

(52) U.S. Cl.
USPC ..... 227/3; 227/2; 227/131

(58) Field of Classification Search
USPC ..... 227/1, 2, 3, 5, 131
See application file for complete search history.

(56) References Cited

U.S. PATENT DOCUMENTS

| | | | | |
|---|---|---|---|---|
| 5,794,831 | A * | 8/1998 | Velan et al. | 227/2 |
| 6,057,682 | A * | 5/2000 | McCurley et al. | 324/207.23 |
| 6,094,357 | A | 7/2000 | Deubler et al. | |
| 6,318,615 | B1 * | 11/2001 | Walter | 227/10 |
| 6,955,281 | B1 * | 10/2005 | Wei | 227/2 |
| 2004/0222265 | A1 * | 11/2004 | Song | 227/2 |
| 2005/0000998 | A1 | 1/2005 | Grazioli et al. | |
| 2005/0242149 | A1 | 11/2005 | Higuchi | |
| 2007/0012118 | A1 * | 1/2007 | Frank et al. | 73/779 |
| 2008/0011251 | A1 * | 1/2008 | Tanaka | 123/46 SC |
| 2008/0073405 | A1 * | 3/2008 | Shima et al. | 227/131 |
| 2008/0110652 | A1 * | 5/2008 | Wen | 173/1 |

FOREIGN PATENT DOCUMENTS

| | | |
|---|---|---|
| CN | 1665646 | 9/2005 |
| EP | 1 810 792 A1 | 7/2007 |
| JP | 57-89572 | 6/1982 |

(Continued)

*Primary Examiner* — Thanh Truong
*Assistant Examiner* — Nathaniel Chukwurah
(74) *Attorney, Agent, or Firm* — Drinker Biddle & Reath LLP

(57) ABSTRACT

A hand-held tool, in which multiple fasteners are successively fed, is provided with: an ejection detecting portion for detecting an ejection of the fasteners; and a control portion for switching from a power saving wait mode of small power consumption to an active mode capable of executing normal processing when the ejection detecting portion detects the ejection of the fasteners, and for switching from the active mode to the wait mode when the normal processing is ended.

11 Claims, 24 Drawing Sheets

(56) References Cited

FOREIGN PATENT DOCUMENTS

| | | |
|---|---|---|
| JP | 1-115578 | 5/1989 |
| JP | 3-33077 | 4/1991 |
| JP | 6-50768 | 7/1994 |
| JP | 08-52665 | 2/1996 |
| JP | 8-164503 | 6/1996 |
| JP | 8-276376 | 10/1996 |
| JP | 9-27685 | 1/1997 |
| JP | 2001-511944 | 8/2001 |
| JP | 2001-353671 | 12/2001 |
| JP | 2004-34243 | 2/2004 |
| WO | WO 2005/095063 A1 | 10/2005 |
| WO | WO 2007/142997 A2 | 12/2007 |

* cited by examiner

HAND-HELD TOOL, FASTENER RESIDUAL QUANTITY DETECTING MECHANISM, FASTENER RESIDUAL QUANTITY DETECTING METHOD, AND POWER SAVING METHOD

TECHNICAL FIELD

The present invention relates to a hand-held tool for successively feeding multiple fasteners, a fastener residual quantity detecting mechanism, a fastener residual quantity detecting method, and a power saving method. Especially, the invention relates to a hand-held tool carrying an electronic circuit thereon and a power saving method. Also, the invention relates to a fastener residual quantity detecting mechanism and a fastener residual quantity detecting method for detecting the residual quantity of fasteners in a hand-held tool. Further, the invention relates to an electronic part mounting structure for mounting on a circuit substrate electronic parts to be carried on a tool of an impact receiving type.

BACKGROUND ART

For example, in a hand-held tool (which is also hereinafter referred to as a tool simply) such as a nailing machine, nails or screws are loaded into the magazine of a tool main body as fasteners, and are then ejected from the magazine. However, when an operator is not aware that the fasteners have been used up, there occurs a blank striking. In this case, for example, there is a fear that a member to be fastened such as a gypsum board can be damaged by a driver bit.

As means for solving this problem, it is expected to provide in a tool main body a blank striking preventive mechanism capable of preventing such blank striking. Also, it is expected to carry on the tool main body a blank striking preventive electronic apparatus capable of detecting the residual quantity of fasteners using an electronic part such as a sensor.

Here, conventionally, there is disclosed a detecting apparatus for detecting that a residual quantity of staples in a magazine is zero or small (for example, see the patent reference 1). Also, conventionally, there is disclosed a staple striking apparatus including a sensor for monitoring a feed of staples when the staples are consumed (for example, see the patent reference 2). Further, conventionally, a staple striking machine operation detecting apparatus which detects the movement of a staple advancing following the staple striking operation (for example, see the patent reference 3).

Patent Reference 1: JP-U-3-33077

Patent Reference 2: JP-A-57-89572

Patent Reference 3: JP-A-8-164503

However, the technologies respectively disclosed in the patent reference 1 to 3 relate to a stapling apparatus built in an electric stapler/copying machine placed on a base, and an automatic staple striking apparatus for striking staples under an automatic control.

When the above-mentioned blank striking preventive mechanism is provided on a hand-held tool, a weight of the hand-held tool is increased due to the present preventive mechanism. As a result, there is generated an inconvenience in the hand-held tool, for example, the hand-held tool is harder to use. Also, in some cases, in a state where the residual quantity of fasteners is not known, an operator can recognize for the first time an absence of the fastener after the operator conducts the blank striking. For example, when the operator works on a stepladder or the like, if the fastener runs short during the operation on the stepladder, the operation of the operator after then becomes complicated. Specifically, in order to load new fasteners, the operator must carry out troublesome operations; for example, the operator must climb down from the stepladder. Such operations cause the operator to waste time and labor.

Also, when the above-mentioned blank striking preventive electronic device is carried on the hand-held tool, although an electronic part such as a CPU or a sensor is small in size and light in weight, a power source part such as a battery is large in size and heavy in weight compared with the electronic part. Therefore, when the terminal of the battery is mounted onto a circuit substrate by soldering or the like, due to an impact of ejecting the fastener, there is a fear that the terminal portion of the battery can be broken. In other words, due to an inertia of the battery that is heavy in weight, a load is locally applied onto the terminal portion, whereby the terminal portion is easy to break.

When a piezoelectric vibratory plate for use in an acceleration sensor or a buzzer is mounted onto an electronic part formed in a thin film shape, for example, in a household appliance, there is generally used a method in which the outer peripheral edge of the piezoelectric vibratory plate is held by and between two parts.

As a method for avoiding the above-mentioned breakage of the battery terminal portion, there can also be expected a method in which, after the battery is mounted on the circuit substrate, the battery is further bonded to the circuit substrate using silicone-system resin or the like. However, in this method, the mounting process is hard to be automated, and also the bonding amount of the battery is difficult to control, because poor bonding sometimes occurs. Further, since the number of steps of mounting the battery increases, the mounting operation is complicated and also the mounting cost is increased.

Also, in the case of the thin-film-shaped electronic part, when the above-mentioned general method is used in a hand-held tool such as a hand tool, there are necessary exclusive parts (the above-mentioned two parts) which are used to hold the piezoelectric vibratory plate between them, whereby the weight of the whole of the tool is increased. Further, there can also be expected a method in which parts existing already are used to hold the vibratory plate between them. However, in this method, the piezoelectric vibratory plate cannot be always mounted in such a manner that, for example, an acceleration speed can be detected sufficiently or a buzzer can sound properly.

SUMMARY OF INVENTION

One or more embodiments of the invention provide a hand-held tool capable of mounting a power supply part small in size and light in weight.

Also, one or more embodiments of the invention provide a fastener residual quantity detecting mechanism and a fastener residual quantity detecting method for use in a hand-held tool.

Further, one or more embodiments of the invention provide an electronic part mounting structure in which a mounting structure for mounting an electronic part to be incorporated in an impact-receiving tool such as a hand-held tool can be reduced in size and weight at a low cost.

In accordance with one or more embodiments of the invention, a hand-held tool in which multiple fasteners are successively fed is provided with: an ejection detecting portion configured to detect an ejection of the fasteners; and a control portion configured to switch from a power saving wait mode of small power consumption to an active mode capable of executing normal processing when the ejection detecting portion detects the ejection of the fasteners, and configured to switch from the active mode to the wait mode when the normal processing is ended.

Here, the above structure may further include a residual quantity detecting portion for detecting the residual quantity of the fasteners. And, when, according to the control portion, the residual quantity detecting portion, after transition to the active mode, detects that the residual quantity of the fasteners is a given number or more, the mode may be switched from the active mode to the wait mode.

Here, the normal processing includes: processing to detect the residual quantity of fasteners; alarm processing to emit a warning light, generate warning sounds, warning vibrations, display a warning and the like; processing to count the number of fasteners struck out; and other similar processing. Also, for example, in the case that the residual quantity of the fasteners is a given number of less, the alarm processing may be carried out for a given time and, after then, the mode may be returned from the active mode to the wait mode.

Further, in accordance with one or more embodiments of the invention, a power saving method of a hand-held tool in which multiple fasteners are successively fed is provided with: switching from a power saving wait mode of small power consumption to an active mode capable of executing normal processing, when an ejection of the fasteners is detected; and switching from the active mode to the wait mode, when the normal processing is ended.

In the above-mentioned hand-held tool and power saving method, when the ejection of the fasteners is detected, the mode is switched from the wait mode to the active mode and, after execution of the normal processing, the mode is returned to the wait mode. This can reduce the power consumption of the electronic parts of the hand-held tool and thus a power supply part small in size and light in weight such as a battery can be carried on the hand-held tool. That is, with use of a hand-held tool and power saving method according to one or more embodiments of the invention, for example, the weight of an electronic device for prevention of striking a blank fastener can be controlled down to a necessary minimum weight, thereby being able to provide a hand-held fastener successively feeding tool which is easy to handle. Specifically, while the present hand-held fastener successively feeding tool is structured in such a manner that it is substantially equal in weight to a conventionally existing hand-held fastener successively feeding tool and uses the same exterior parts as such existing tool, the above-mentioned electronic device for prevention of striking of a blank fastener can be carried onto or post-attached to the present tool.

Further, in accordance with one or more embodiments of the invention, a fastener residual quantity detecting mechanism of the hand-held tool, in which multiple fasteners are successively fed, is provided with a residual quantity detecting portion for detecting a residual quantity of fasteners. Here, the fastener residual quantity detecting mechanism may also include a counter portion for counts the residual quantity of the fasteners. In the fastener residual quantity detecting mechanism, multiple detecting parts for detecting the residual quantity of the fasteners are formed as an assembled/completed single unit product and removably mounted on a main body of the hand-held tool.

Further, in accordance with one or more embodiments of the invention, a fastener residual quantity detecting method of a hand-held tool, in which multiple fasteners are successively fed, is provided with: detecting the residual quantity of the fasteners. Here, the fastener residual quantity detecting method may also be so formed as to count the residual quantity of the fasteners. Also, in the case that the residual quantity of the fasteners has decreased down to a given quantity, a warning light may be emitted, warning sounds may be generated, warning vibrations may be generated, a warning may be displayed, and the like.

In the above-mentioned fastener residual quantity detecting mechanism and fastener residual quantity detecting method, since the residual quantity of the fasteners is detected, the presence or absence of the fasteners can be easily checked without striking the screw actually. That is, according to the fastener residual quantity detecting mechanism and fastener residual quantity detecting method, since the striking of a blank fastener can be prevented, a member to be fixed can be prevented against damage. Also, according to the fastener residual quantity detecting mechanism and fastener residual quantity detecting method, since an operator can confirm that the residual quantity of the fasteners is small without opening the magazine, the hand-held tool using such detecting mechanism and method is easier to handle. Specifically, since the operator can confirm in advance that the fasteners must be loaded, for example, before the operator mounts a stepladder, the operator can load the stop member, thereby allowing the operator to save wasting time and labor.

Here, in the case that the counter portion is provided, since the residual quantity of the fasteners is counted, the residual quantity of the fasteners can be confirmed easily. Also, in the case that multiple detecting parts for detecting the residual quantity of the fasteners are removably mounted on the tool main body as assembled/completed unit products (unit assemblies), such assemblies can be mounted onto and removed from the tool main body simply and quickly. That is, in the case that the detecting parts are structured as the unit assemblies, since they can be post-mounted onto the above-mentioned tool made of a conventionally existing tool, various kinds of maintenance and replacement can be carried out easily.

Also, according to one or more embodiments of the invention, there is provided an electronic part mounting structure for connecting an electronic part heavy in weight to a circuit substrate, in which the electronic part is connected to the circuit substrate through a conductor, and the electronic part is stored into a storage portion in a floating state.

Here, the electronic part heavy in weight is a power supply part such as a battery. Also, the floating state means that the terminal of the battery or the like is not connected (fixed) directly to the circuit substrate but is movably disposed (stored) within the storage space of the storage portion. That is, it means that the battery or the like is held in a free state in which it is not fixed to the storage portion either.

According to the electronic part mounting structure, since the terminal of the battery or the like is not fixed to the circuit substrate by soldering or the like but is connected to the circuit substrate through the conductor and is also stored in the storage portion in a floating state, even in the case that an impact is applied to the electronic part, the electronic part does not have such portion as can receive a local load due to inertia. That is, according to the present electronic part mounting structure, since the electronic part is connected through the conductor and is also stored in the storage portion in a floating state, the electronic part can be held within the storage portion in a stable state and is thereby enhanced in the impact resistance thereof. Also, for example, when compared with a case in which the electronic part is stuck using silicone-system resin, the cost of the electronic part mounting structure can be reduced.

Further, in accordance with one or more embodiments of the invention, in an electronic part mounting structure, an electronic part having a thin film shape is so disposed as to correspond to amounting hole which is formed in the circuit substrate. Here, the electronic part having a thin film shape is, for example, a piezoelectric vibration plate which is used in an acceleration sensor or a buzzer. Also, the mounting hole includes, for example, a through hole the peripheral surface of which is coated with copper foil.

In the electronic part mounting structure, since the thin-film-shaped electronic part is so disposed as to correspond to the mounting hole formed in the circuit substrate, the electronic part mounting structure can provide stable performance with a simple structure and also can be reduced in size and weight at a low cost. That is, according to the electronic part mounting structure, since the thin-film-shaped electronic part is so disposed as to correspond to the mounting hole formed in the circuit substrate, for example, there is eliminated the need for use of two exclusive parts for holding such electronic part between them. Thus, the electronic part can be so mounted as to be able to fulfill its performance fully. In this case, for example, a buzzer can sound well.

Other aspects and advantages of the invention will be apparent from the following description and the appended claims.

BRIEF DESCRIPTION OF DRAWINGS

FIG. 8 is a perspective view of a detecting lever shown in FIG. 7, showing a state in which the lever is on.

FIG. 23 is a view of the reed switch shown in FIG. 22, showing a state in which it is on.

DESCRIPTION OF REFERENCE NUMERALS AND SIGNS

Figure 1:
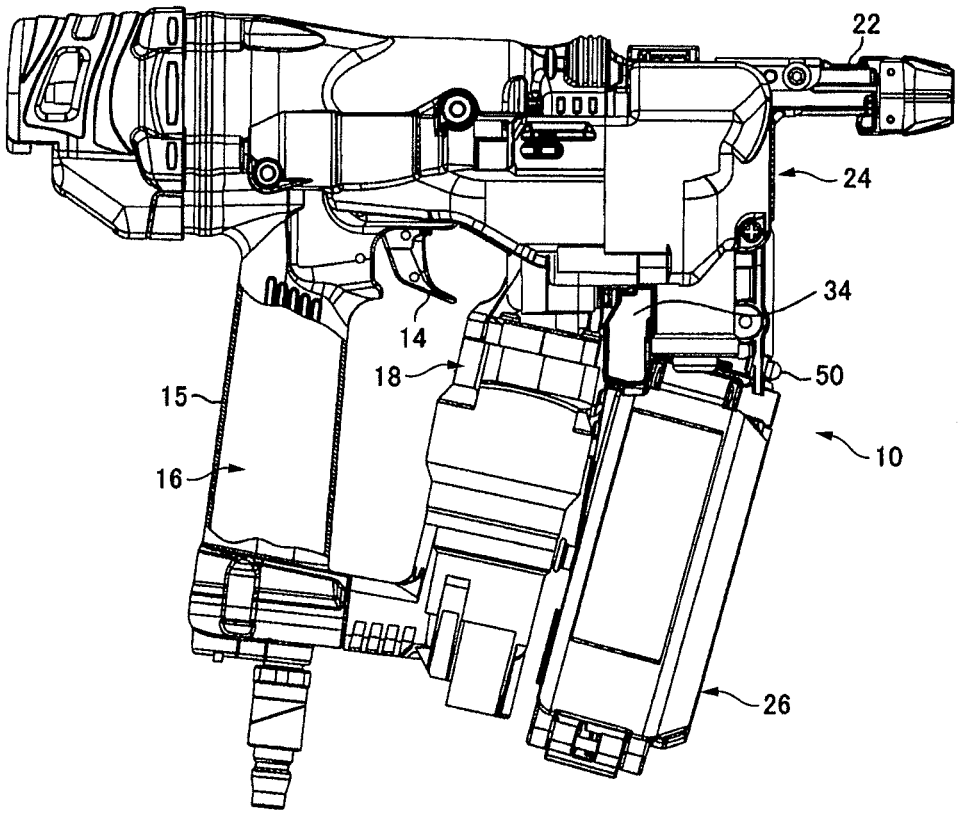
FIG. 1 is a side view of a screw striking machine according to a first exemplary embodiment of the invention.

10: Screw striking machine (hand-held tool)
34: Detecting box
35: Storage portion
36: Detecting lever (residual quantity detecting part)
42: Magnet (residual quantity detecting part)
44: Circuit substrate
45: Through hole (mounting hole)
46: Hall element (residual quantity detecting part)
48: Acceleration sensor (thin-film-shaped electronic part, counter portion, ejection detecting portion)
50: LED (electronic part heavy in weight)
56: Conductor
60: Detecting box
90: CPU (detecting portion, counter portion, residual quantity detecting portion, ejection detecting portion)
W: Screw (fastener)
WN: Screw connecting belt
S: Screw residual quantity detecting mechanism (fastener residual quantity detecting mechanism)

DESCRIPTION OF EMBODIMENTS

<First Exemplary Embodiment>

Now, description will be given below of a first exemplary embodiment according to the invention with reference to FIGS. 1 to 16. Here, a hand-held tool in the present embodiment will be described as a hand-held air-drive-type screw striking machine 10, while a fastener will be described as a screw.

Figure 2:
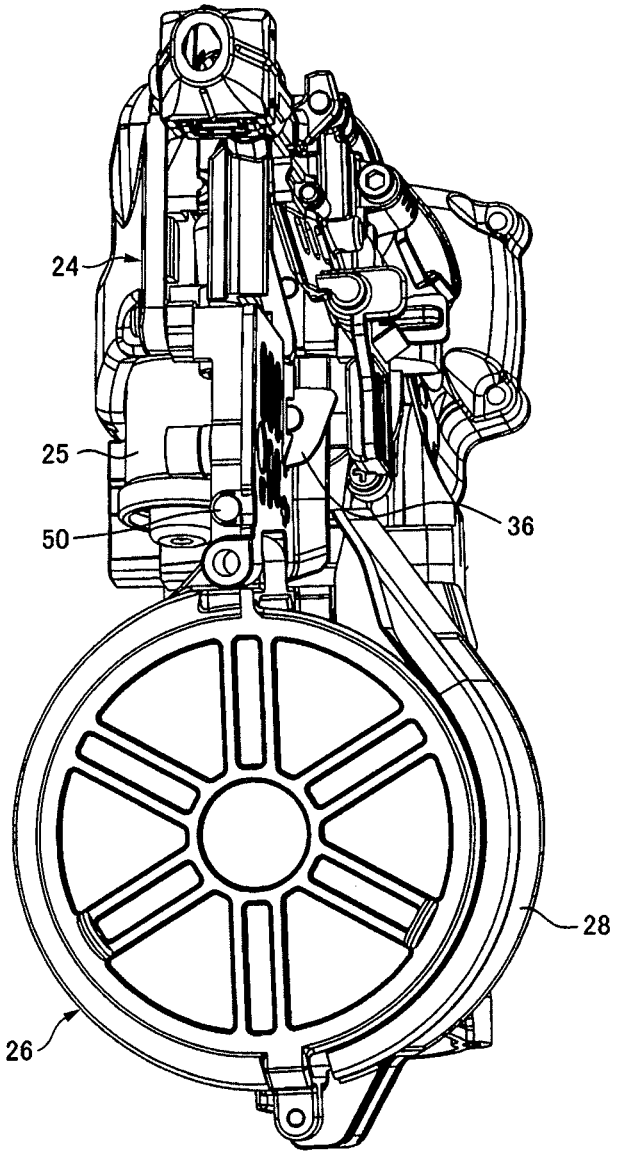
FIG. 2 is a perspective view of the screw striking machine shown in FIG. 1, when it is viewed from front.
Figure 3:
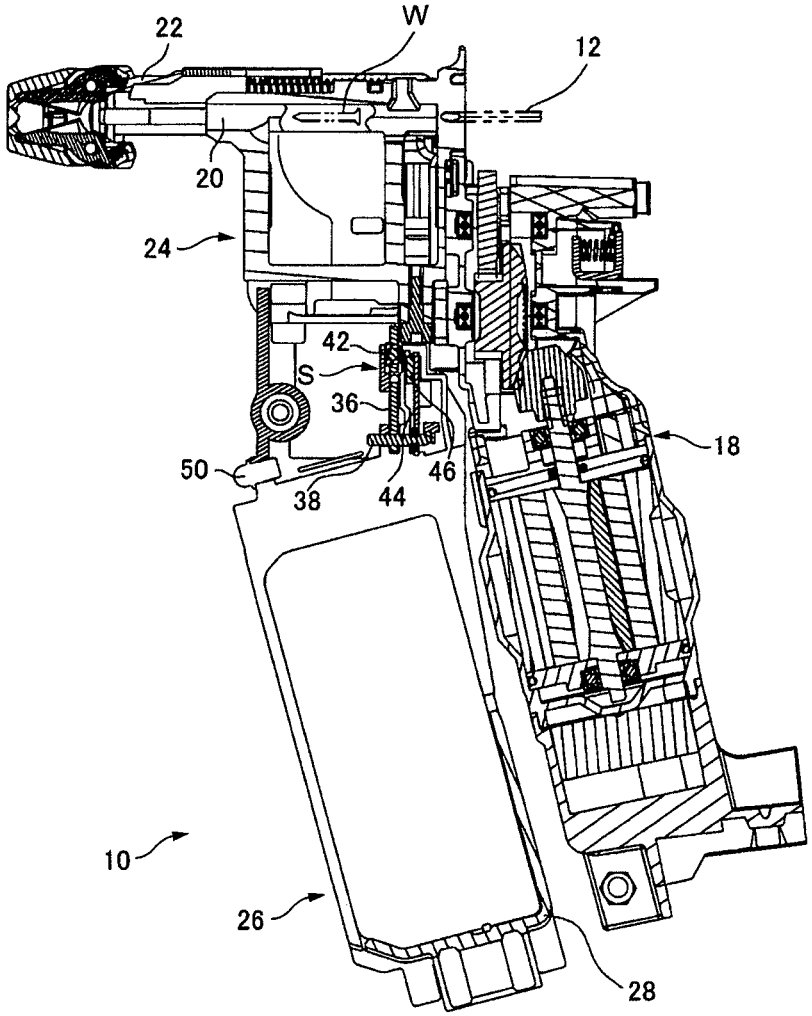
FIG. 3 is a section view of the main portions of the screw striking machine shown in FIG. 1.
Figure 4:
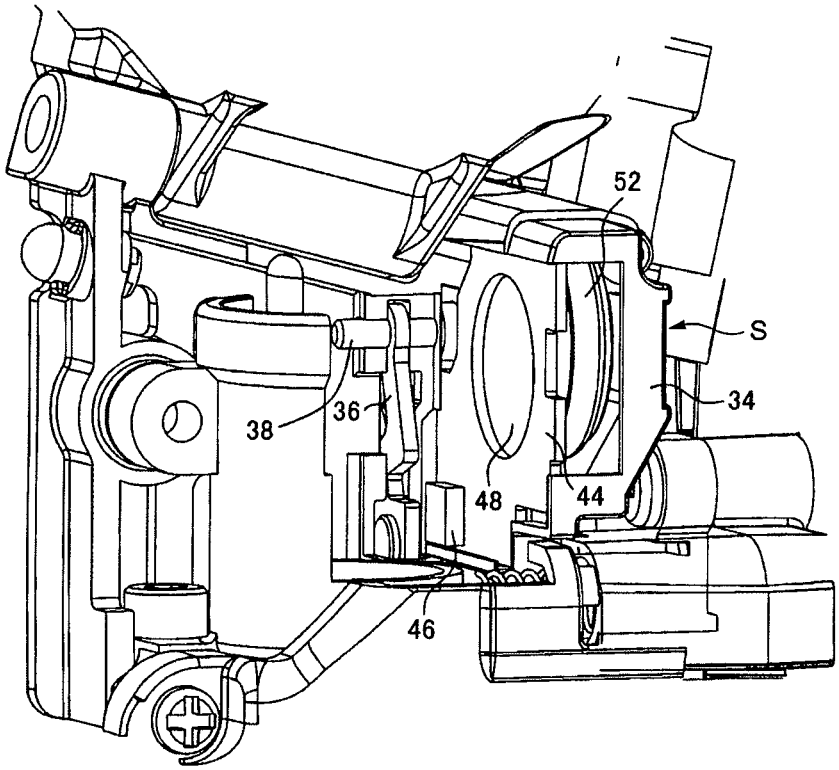
FIG. 4 is a perspective view of the main portions of a screw residual quantity detecting mechanism shown in FIG. 3.
Figure 6:
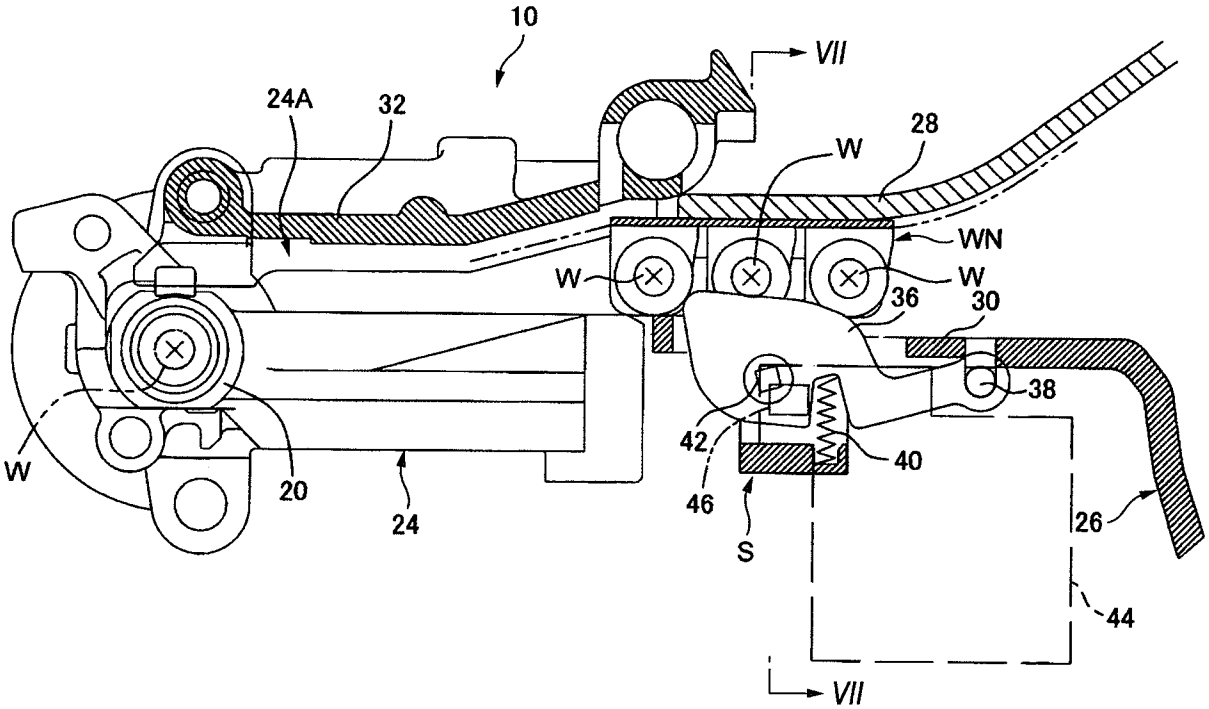
FIG. 6 is a side view of the screw residual quantity detecting mechanism shown in FIG. 4, showing a state in which it detects the screws.
Figure 7:
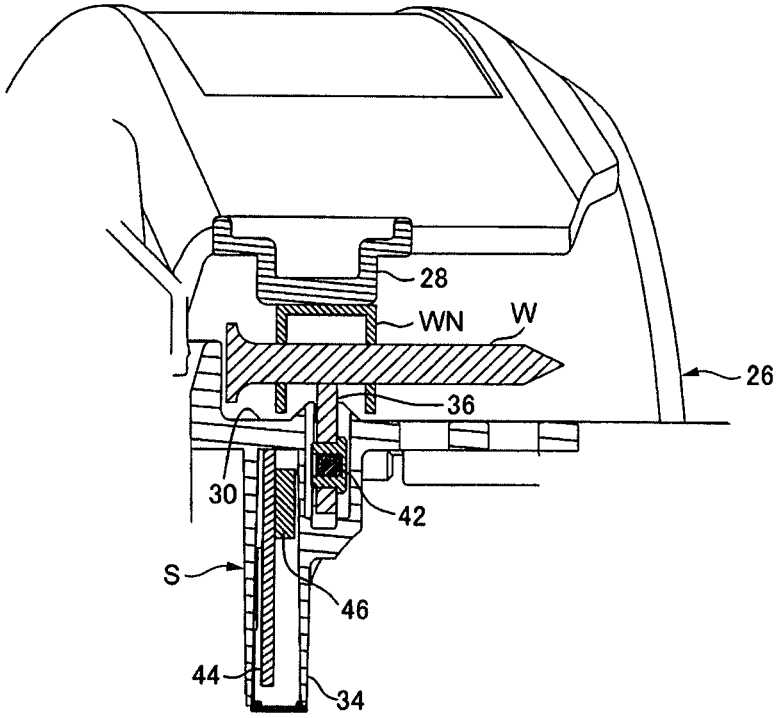
FIG. 7 is a section view taken along the VII-VII line shown in FIG. 6.
Figure 8:
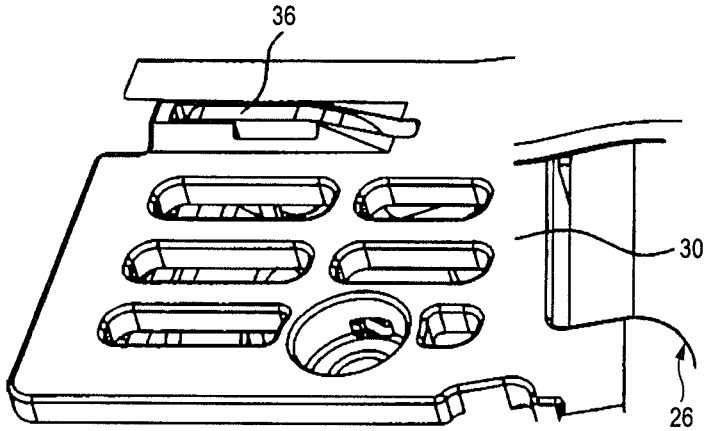
Figure 9:
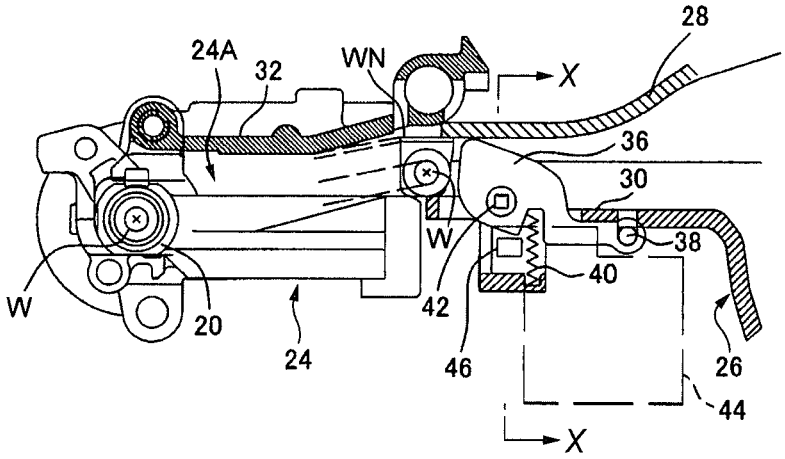
FIG. 9 is a side view of the screw residual quantity detecting mechanism shown in FIG. 4, showing a state in which it does not detect the screws.
Figure 10:
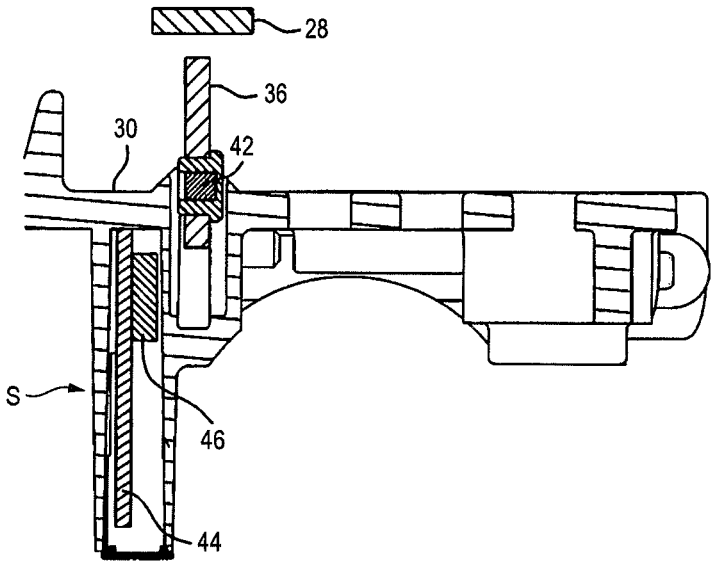
FIG. 10 is a section view taken along the X-X line shown in FIG. 9.

FIG. 1 is a side view of the screw striking machine 10, FIG. 2 is a perspective view of the screw striking machine 10, FIG. 3 is a section view of the main portions of the screw striking machine 10, FIG. 4 is a perspective view of the main portions of a fastener residual quantity detecting mechanism, FIGS. 6 and 7 are respectively views of a detecting lever provided in the fastener residual quantity detecting mechanism, showing a state in which it is detecting a screw W, and FIGS. 8 to 10 are respectively views of the initial state of the detecting lever.

(Schematic Structure of Screw Striking Machine 10)

A screw striking machine 10 shown in FIG. 1 includes a striking mechanism and a screw tightening mechanism (neither of them is shown). The striking mechanism includes a striking cylinder, a striking piston slidably disposed within the striking cylinder, and a driver bit 12 (see a two-dot chained line shown in FIG. 3) which is connected to the striking piston integrally therewith). And, as shown in FIG. 1, when a trigger 14 is operated or pulled, compressed air is supplied into the striking cylinder from an air chamber 16 (which is connected to an air supply source) in which the compressed air is stored, whereby the driver bit 12 shown in FIG. 3 is caused to carry out its striking operation. Here, as shown in FIG. 1, the air chamber 16 is formed in the interior portion of a grip portion 15.

The screw tightening mechanism (not shown), using the power of an air motor, causes the driver bit 12 (see FIG. 3) to carry out a tightening operation. That is, almost simultaneously with the start of the operation of the striking mechanism, a portion of the compressed air supplied from the air chamber 16 shown in FIG. 1, as shown in FIG. 3, is supplied to the air motor 18, whereby the driver bit 12 is rotated about its own axis. And, a screw W (see a two-dot chained line shown in FIG. 3) situated at an ejection opening (that is, existing at an ejection position) is tightened into a member to be tightened (not shown) such as a gypsum board by the rotating drive bit 12.

Here, the above-mentioned ejection opening is formed in a nose portion 20 (which will be discussed later). Also, the above-mentioned striking mechanism and screw tightening mechanism respectively have similar structures to conventionally known structures such as those disclosed in the patent publication No. 2001-353671 and the like and thus more detailed description thereof is omitted here.

As shown in FIG. 3, the screw striking machine 10 includes a nose portion 20 for ejecting the screw W therefrom and a contact member 22 which is slidably disposed in the nose portion 20 and serves as a safety device. The contact member 22 is structured such that it can be energized to project out toward the striking side of the screw W and also, only when the contact member 22 is pressed against the member to be tightened, the operation of a trigger 14 (see FIG. 1) can be made effective. Also, the contact member 22 is temporarily secured to a contact stopper (not shown) in the above-mentioned pressed time. And, the contact member 22 is further structured such that, when the striking mechanism operates and contact stopper moves, it can project toward the striking side again.

(Structure of Screw Residual Quantity Detecting Mechanism S)

As shown in FIG. 3, in the screw striking machine 10, there are disposed a screw feed device 24 and a magazine 26 in such a manner that they are connected continuously with the nose portion 20. Multiple screws W within the magazine 26 can be fed sequentially to the ejection position of the nose portion 20 by the screw feed device 24. Here, the screw feed device 24 includes an air actuator 25 which is shown in FIG. 2 and is used to feed the screws.

On the magazine 26, there is rotatably disposed a cover 28 shown in FIG. 2. And, the cover 28 covers a guide portion 30 shown in FIG. 6. Here, as shown in FIG. 6, the multiple screws W are respectively mounted on a long connecting belt WN, and the connecting belt WN is stored into the magazine 26 in a state where it is wound in a roll shape.

Also, as shown in FIG. 6, a rotatable cover 32 covers the screw feed portion 24A of the screw feed device 24. And, as shown in FIGS. 6 and 7, in a state where the cover 28 or 32 is locked, the cover 28 or 32 presses the connecting belt WN toward the guide portion 30 or screw feed portion 24A to thereby hold the screws W at a given height.

The screw residual quantity detecting mechanism S, as shown in FIGS. 4 to 7, includes: a detecting box 34 for storing therein multiple detection parts such as a circuit substrate 44 (which will be described herein later), a detecting lever 36 and so on. The detecting lever 36, which constitutes a part of a residual quantity detecting portion, can be rotated about the center of a shaft 38 in a given range and can be contacted with the screw W that is situated in the guide portion 30. That is, as shown in FIGS. 6 and 9, the detecting lever 36 is always energized by a spring 40 toward the guide portion 30, namely, toward the screw W (see FIG. 6) that is situated in the guide portion 30. On the detecting lever 36, there is disposed a magnet 42 which constitutes a part of the residual quantity detecting portion. Here, the shaft 38 is disposed in the guide portion 30 of the magazine 26.

Figure 5:
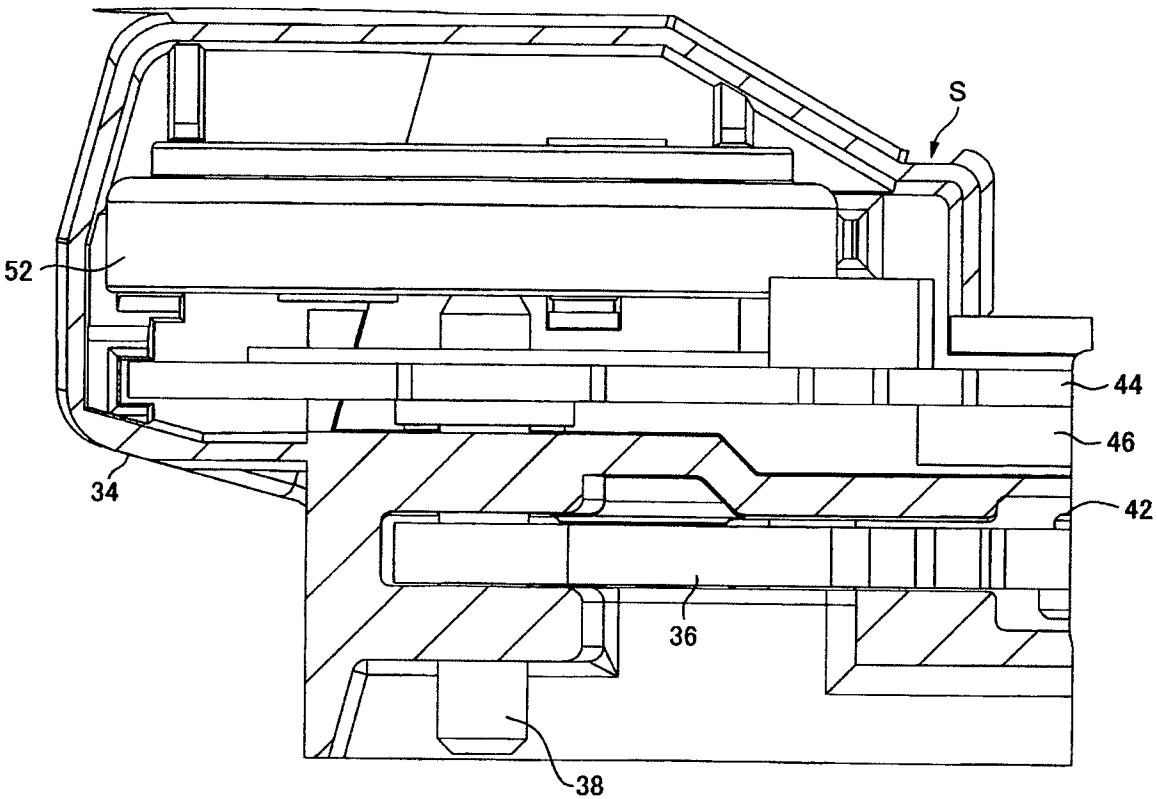
FIG. 5 is an enlarged section view of the screw residual quantity detecting mechanism shown in FIG. 3.

On the other hand, as shown in FIGS. 4 and 5, within the detecting box 34, there is disposed a circuit substrate 44 and, on the circuit substrate 44, there are mounted electronic parts such as a Hall element 46 which forms a part of the residual quantity detecting portion. As shown in FIGS. 4 and 7, the Hall element 46 is disposed such that, when the detecting lever 36 detects the screws W to be fed to the guide portion 30, it faces a magnet 42.

That is, when the screws W are fed to the guide portion 30, the detecting lever 36 is returned back against the energizing force of the spring 40 and is thereby turned into its on state (a state shown in FIGS. 6 to 8) in which the magnet 42 and Hall element 46 face to each other. On the other hand, as shown in FIGS. 9 and 10, in the case that the screws W are not situated in the guide portion 30, that is, in the case that the residual quantity of the screws W is small, the detecting lever 36 is turned into its off state (a state in which the magnet 42 is separated from the Hall element 46) in which the detecting lever 36 is energized up to the vicinity of the cover 28 by the energizing force of the spring 40.

As shown in FIG. 4, on the circuit substrate 44, there is disposed an acceleration sensor 48 which is a piezoelectric element. The acceleration sensor 48 constitutes a part of an ejection detecting portion and is formed in a thin film having a diameter of 10 to 30 mm. The acceleration sensor 48 detects that the screw W is struck by the above-mentioned striking mechanism. That is, this acceleration sensor 48 converts a force (an impact force) applied to a piezoelectric member to a voltage. And, the acceleration sensor 48 is also structured such that it can output a detecting signal (an on signal) according to an impact given when the screw W is actually struck by the screw striking machine 10.

Here, the reasons why the acceleration sensor 48 is formed as a part of the ejection detecting portion are as follows. That is, the first reason is that an electronic circuit to be provided into the screw striking machine 10 can be formed as a complete module. For example, in the case that there is provided a detecting switch which can be operated in linking with the pulling operation of the trigger 14 shown in FIG. 1, a structure to be attendant on this detecting switch is complicated to thereby lower the freedom of design. However, since the acceleration sensor 48 made of a piezoelectric element needs the structure that can receive only the impact, it can be provided even on the circuit substrate 44 (see FIG. 4), that is, the freedom of design can be enhanced and the post-attachment of the acceleration sensor 48 can be realized easily.

Secondly, as described above, since the acceleration sensor 48 is a sensor which converts the force to be applied to the piezoelectric member to the voltage, it does not consume electric power. Especially, as in the present embodiment, in the case of a hand-held fastener successively feeding tool of a compressed air drive type, it is necessary to save electric power as much as possible. Therefore, from this viewpoint, the acceleration sensor 48 is the best.

Here, with reference to FIG. 11, description will be given of a mounting structure for mounting the acceleration sensor 48, which is an electronic part, onto the circuit substrate 44. In the circuit substrate 44, there is opened up a through hole 45 serving as a mounting hole having a diameter slightly smaller than the acceleration sensor 48. Here, since the mounting hole is formed as a through hole 45, a copper foil 45A is coated on the peripheral surface of the hole. However, the mounting hole may also be formed as a simple opening besides the through hole.

And, the acceleration sensor 48 is put on the outer edge portion 44A of the circuit substrate 44 having the through hole 45 and is then soldered thereto. Here, according to the present embodiment, instead of soldering, the acceleration sensor 48 may also be bonded to the circuit substrate 44. However, generally, the mounting structure can be produced at a lower cost by the soldering operation than the bonding operation.

Figure 11:
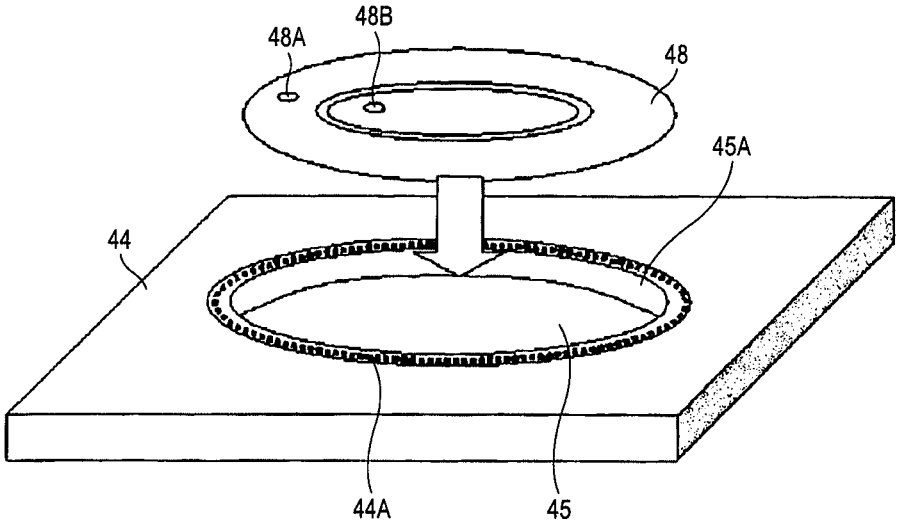
FIG. 11 is an explanatory view of a structure for mounting an acceleration sensor shown in FIG. 4.

Here, a pair of conductors (not shown), as shown in FIG. 11, are soldered (48A, 48B) to the outer and inner peripheral portions of the acceleration sensor 48 and are thereby connected thereto respectively. Due to this connection, the acceleration sensor 48 is allowed to supply the above-converted voltage in the impact receiving time to a CPU 90, and the CPU 90 counts the number of times of screw striking.

According to the present embodiment, since the acceleration sensor 48 is soldered to the circuit substrate 44 in such a manner that it corresponds to the through hole 45, the screw residual quantity detecting mechanism S can have stable performance with a simple structure and also the cost and size of the detecting mechanism S can be reduced. That is, according to the present embodiment, since the acceleration sensor 48 is disposed such that it corresponds to the through hole 45 formed in the circuit substrate 44, for example, two exclusive parts for holding the acceleration sensor 48 between them can be omitted, and also the acceleration sensor 48 can be mounted in such a manner that it can fully fulfill its performance capable of detecting acceleration completely.

In the detecting box 34, there is provided a battery 52 of a button-like shape. Thus, power can be supplied to electronic parts such as an LED 50 and the like from the battery 52 serving as a power supply part.

Here, with reference to FIGS. 12 and 4, description will be given of a mounting structure which connects the battery 52 consisting of an electronic part to the circuit substrate 44 and mounts the battery 52 into a storage portion 35 formed in the detecting box 34. Since FIG. 12 is an explanatory view of the structure for connecting the battery 52 to the circuit substrate 44, the above-mentioned through hole 45 is not shown there.

Figure 12:
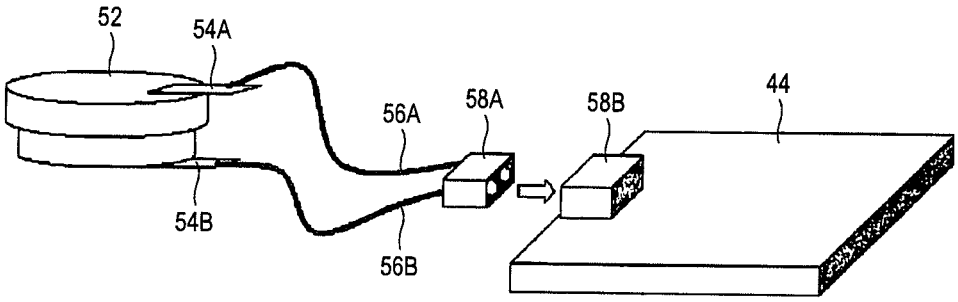
FIG. 12 is an explanatory view of a structure for mounting a battery shown in FIG. 4.

As shown in FIG. 12, the battery 52 and circuit substrate 44 are connected to each other through tub terminals 54A and 54B, conductors 56A and 56B, and connectors 58A and 58B. And, as shown in FIGS. 4 and 5, within the detecting box 34, specifically, within the storage portion 35 separated by the circuit substrate 44, there is stored the battery 52 in a floating manner.

Here, the tab terminals 54 are fixed to the battery 52 by spot welding, while one end of each conductor 56 is soldered to the tab terminal 54. Also, the other end of the conductor 56 is connected to the connector 58A, and the connectors 58A and 58B are connected together, whereby the electric power can be supplied to electronic parts and the like provided on the circuit substrate 44.

Here, the battery 52 is held by a securing member (not shown) in such a manner that it is prevented from dropping down from the storage portion 35. Also, in FIGS. 4 and 5, there are not shown the conductors 56A, 56B and connectors 58A, 58B which are shown in FIG. 12.

According to the present embodiment, since the terminals of the battery 52 and the like are not fixed to the circuit substrate 44 by soldering or the like but the battery 52 is connected to the circuit substrate 44 through the conductors 56 and are stored in the storage portion 35 in a floating manner, even in the case that an impact is given to the battery 52, the battery 52 does not have a portion which receives a local load due to inertia. That is, according to the present embodiment, since the battery 52 is connected through the conductors 56 and is stored in the storage portion 35 in a floating manner, the battery 52 can be held in a stable state within the storage portion 35 and also can be enhanced in the impact resistance. Also, according to the present embodiment, when compared with a case in which the battery is bonded using silicone system resin or the like, it can be provided at a low cost.

As shown in FIGS. 1 to 3, according to the screw striking machine 10, on the upper side of the magazine 26, there is disposed the LED 50. This LED 50 constitutes a part of an alarm portion which, when the residual quantity of the screws W is small, blinks. The radiating direction of the LED 50 is the same as the ejecting direction of the screws W.

Here, the radiating direction of the LED 50 can be changed arbitrarily, for example, the LED 50 may also be disposed in such a manner that it faces an operator. On the other hand, in the case that the LED 50 is mounted in a direction to radiate a member to be tightened, since the operator recognizes the reflected light of the LED 50 from the member to be tightened, it is possible to prevent the operator from overlooking the blinking of the LED 50. That is, this is because the attention of the operator working is generally directed rather to the member to be tightened than the screw striking machine 10.

Here, since the composing parts of the screw striking mechanism S are the button type battery 52, acceleration sensor 48 consisting of a piezoelectric element, Hall element 46, magnet 42 and the like shown in FIG. 4 and are thus light weight, the weight of the screw striking machine 10 is controlled down to a necessary minimum weight.

(Structure of Control System of Screw Residual Quantity Detecting Mechanism S)

Figure 13:
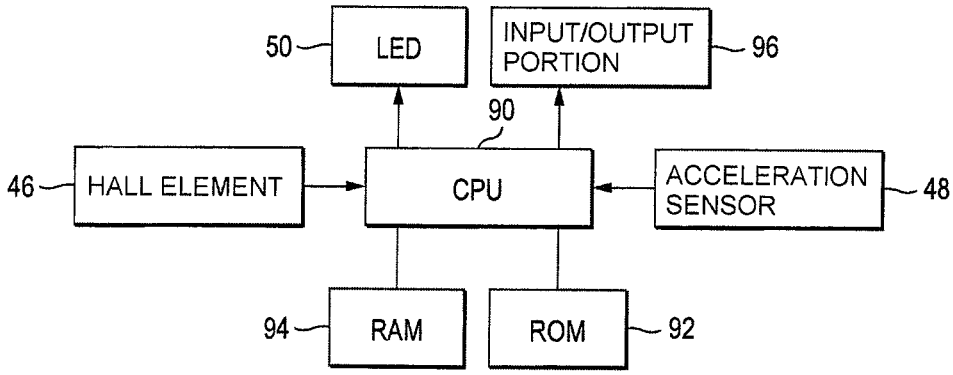
FIG. 13 is a block diagram of the screw striking machine shown in FIG. 3.

As shown in FIG. 13, the screw residual quantity detecting mechanism S includes a CPU 90, a ROM 92, a RAM 94, an input/output portion 96, a Hall element 46, an acceleration sensor 48 and an LED 50. The CPU 90 carries out the general operation of the screw residual quantity detecting mechanism S. For example, in the case that the screws W are struck by the striking mechanism, the CPU 90 counts the residual quantity of the screws W. Here, the CPU 90 serves as a control portion and also constitutes a part of the ejection detecting portion, residual quantity detecting portion and counter portion.

The ROM 92, which serves as a storage portion, stores therein programs respectively for controlling various processings. The RAM 94 includes a record area for reading and writing various data and, into this record area, there are recorded striking data and the like. To the input/output portion 96, there is connected an external memory such as a USB memory (not shown), or an external communication terminal and the like. And, through the input/output portion 96, there are carried out the delivery and receipt of data about the total count number of screws struck or repair history data, or the transmission and receipt thereof.

(Screw Residual Quantity Detecting Mode)

With reference to flow charts respectively shown in FIGS. 14 and 15, description will be given below of a screw residual quantity detecting mode. Here, the processing of the screw residual quantity detecting mechanism S shown in FIG. 13 is carried out by the CPU 90 and is displayed in the form of the flow charts shown in FIGS. 14 and 15. These programs are previously stored in the program area of the ROM 92 (see FIG. 13).

Figure 14:
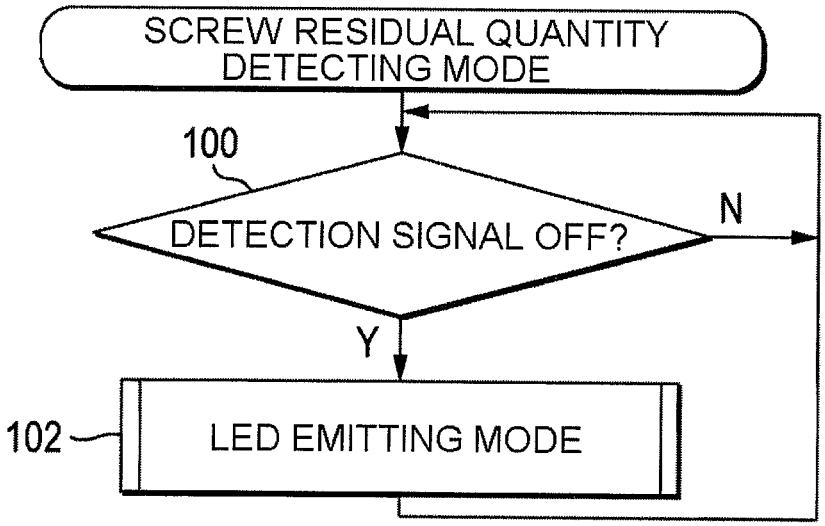
FIG. 14 is a flow chart of the screw residual quantity detecting mode of a screw residual quantity detecting mechanism shown in FIG. 13.
Figure 15:
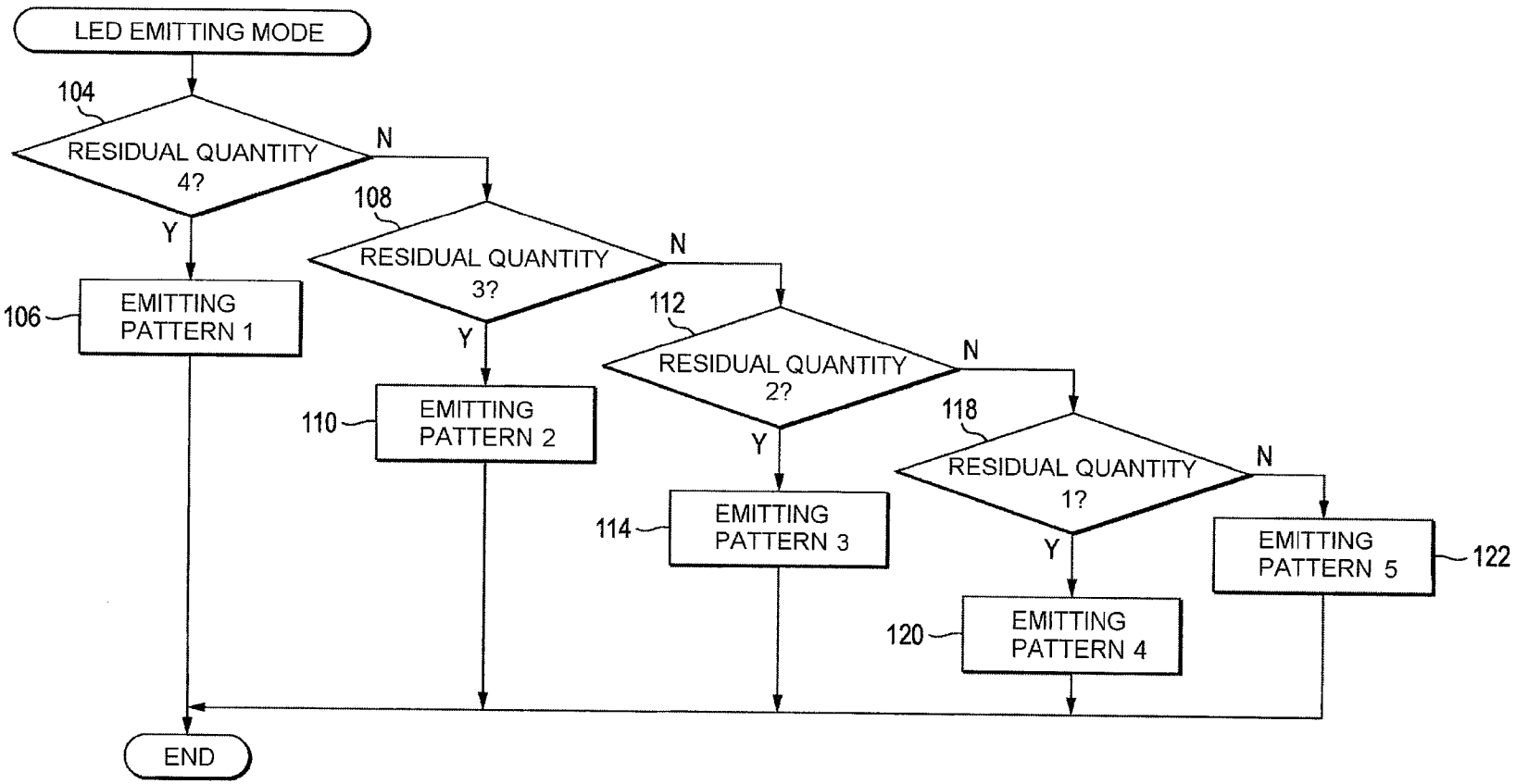
FIG. 15 is a flow chart of an LED light emitting mode shown in FIG. 14.

In Step 100 shown in FIG. 14, the CPU 90 checks whether the detection is off or not. For example, as shown in FIGS. 6 and 7, in the case that the detecting lever 36 detects the screw W, the magnet 42 faces the Hall element 46; and, therefore, a detection signal from the Hall element 46 is on. That is, in Step 100, there is found that the detection is not off and thus the processing of Step 100 is continued until the detection signal becomes off.

On the other hand, as shown in FIGS. 9 and 10, in the case that no screw W is present on the guide portion 30, that is, in the case that the residual number of screws W is small, the detecting lever 36 rotates to the vicinity of the cover 28, and the magnet 42 and Hall element 46 are separated from each other, whereby the detection signal from the Hall element 46 becomes off. Therefore, in Step 100, there is found that the detection is off and thus, in Step 102, the CPU 90 sets up a light emitting mode in which the LED 50 shown in FIGS. 1 to 3 are allowed to emit a light. After execution of the processing of Step 102, the processing goes back to Step 100.

(LED Light Emitting Mode)

In this LED light emitting mode, there are previously set five light emitting patterns 1 to 5 (see FIG. 16) in which the blinking intervals of the LED 50 shown in FIGS. 1 to 3 are different from each other. That is, from the light emitting pattern 1 to the light emitting pattern 5, the blinking intervals become narrower sequentially and, in the light emitting pattern 5, there is provided an on state in which the LED 50 is continuously on. Therefore, according to the present embodiment, since the blinking intervals of the light emitting patterns 1 to 5 are set different from each other, the residual quantity of the screws W can be confirmed visually. Here, the light emitting patterns can be changed arbitrarily. For example, in the case that the screw W runs out, the LED 50 may be caused to blink continuously until a new screw W is loaded, or, in order to save the consumption power, the LED 50 may be blinked only for a given time.

Also, when the residual quantity of screws W is four, this can be confirmed by the fact that the detection signal from the Hall element 46 becomes off. Here, the residual quantity, four, is the number of screws W which exists in the screw feed portion 24A shown in FIG. 9 and at the ejection position. The number of screws W from now on is counted according to the acceleration sensor 48 shown in FIG. 4. Here, the impacts to be given by the above-mentioned striking mechanism are generated twice correspondingly to the forward and backward operations of the driver bit 12 shown in FIG. 3. Therefore, in the case that the detection signal from the acceleration sensor 48 is given twice, the CPU 90 determines that a screw W has been ejected.

Figure 16:
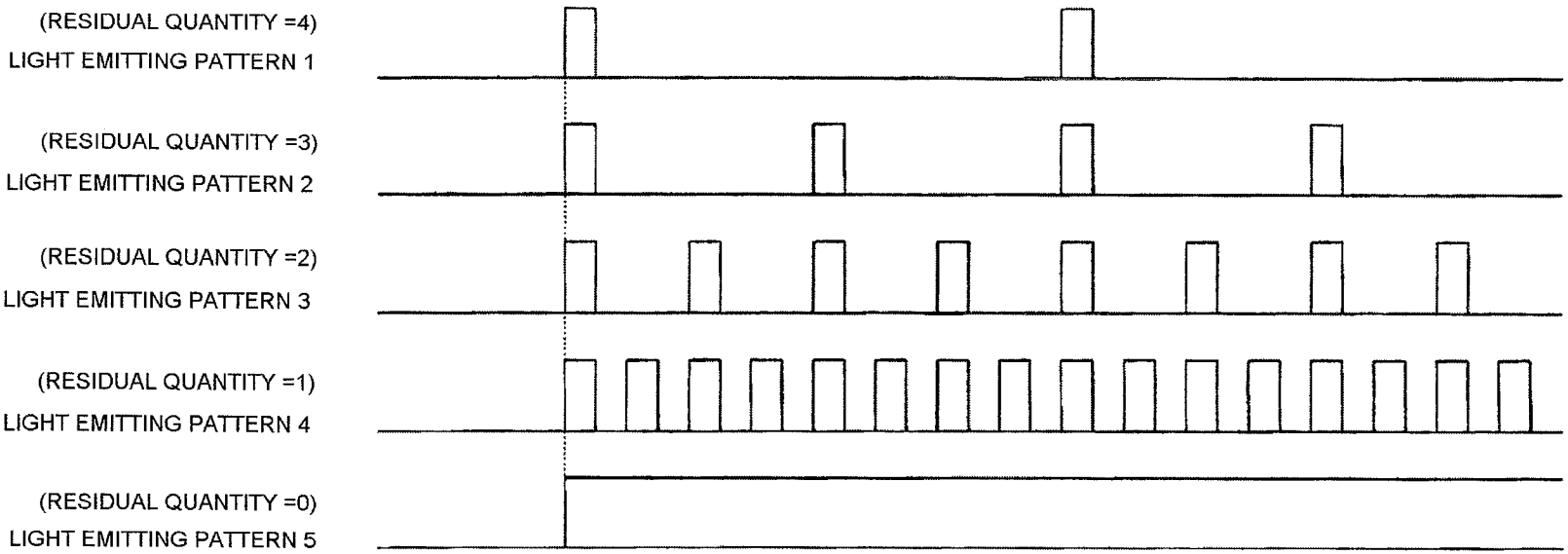
FIG. 16 is an explanatory view of light emitting patterns 1 to 5 respectively shown in FIG. 15.

Now, description will be given below of the subroutine of the light emitting mode with reference to FIG. 15. In Step 102 (see FIG. 14), when there is provided an LED light emitting mode, in Step 104, it is checked whether the residual quantity the screws is four or not. When yes in Step 104, that is, when the residual number is four, in Step 106, a light is emitted according to the light emitting pattern 1. In the light emitting pattern 1, a light is emitted at such blinking interval as shown in FIG. 16, while the blinking interval is longest among the light emitting patterns 1 to 4. That is, since the LED 50 blinks slowly, for example, when a user wants to strike only a single screw, the user can judge that it is not necessary to load a new screw W.

When no in Step 104, in Step 108, it is checked whether the residual quantity is 3 or not. When yes in Step 108, that is, when the residual quantity is 3, in Step 110, a light is emitted according to the light emitting pattern 2 shown in FIG. 16. Here, whether the residual quantity is 3 or not can be determined by the CPU 90 by counting the number of times of receipt of the detection signal of the above-mentioned acceleration sensor 48.

When no in Step 108, in Step 112, it is checked whether the residual quantity is 2 or not. When yes in Step 112, in Step 114, a light is emitted according to the light emitting pattern 3 shown in FIG. 16. When no in Step 112, in Step 118, it is checked whether the residual quantity is 1 or not. When yes in Step 118, that is, when the residual quantity is 1, in Step 120, a light is emitted according to the light emitting pattern 4 shown in FIG. 16.

When no in Step 118, the residual quantity is zero. Therefore, in Step 122, a light is emitted according to the light emitting pattern 5 shown in FIG. 16. That is, the LED 50 shown in FIGS. 1 to 3 is kept on continuously. According to the present embodiment, since the residual quantity of the screws W is detected, without striking the screws actually, it is possible to check easily whether the screws W are present or not. That is, according to the present embodiment, since the striking of a blank screw can be prevented, the member to be tightened can be prevented against damage.

Also, according to the present embodiment, since an operator can recognize the small residual quantity of the screws W without opening the cover 28 or the like, the screw striking machine 10 is easier to use. Specifically, since the operator can recognize the necessity of the loading of a new screw W in advance; for example, the operator can load the screw W before the operator climbs a stepladder, thereby being able to avoid wasting time and labor.

Further, according to the present embodiment, since the residual quantity of the screws W can be easily recognized according to the differences between the blinking intervals of the LED 50, the degree of emergency of the loading timing of the screws W can be recognized easily.

Also, according to the present embodiment, since the composing parts of the screw striking mechanism S are the button type battery 52, acceleration sensor 48 consisting of a piezoelectric element, Hall element 46, magnet 42 and the like shown in FIG. 4 and are thus light in weight, the weight of the screw striking machine 10 is controlled to a necessary minimum value. Here, the flow of the processing of the respective programs described in the present embodiment (see FIGS. 14 and 15) is only an example, and thus various changes and modifications are also possible without departing from the subject matter of the invention.

(Power Saving Mode)

Now, description will be given below of processing to be executed in a power saving mode with reference to a flow chart shown in FIG. 17.

Figure 17:
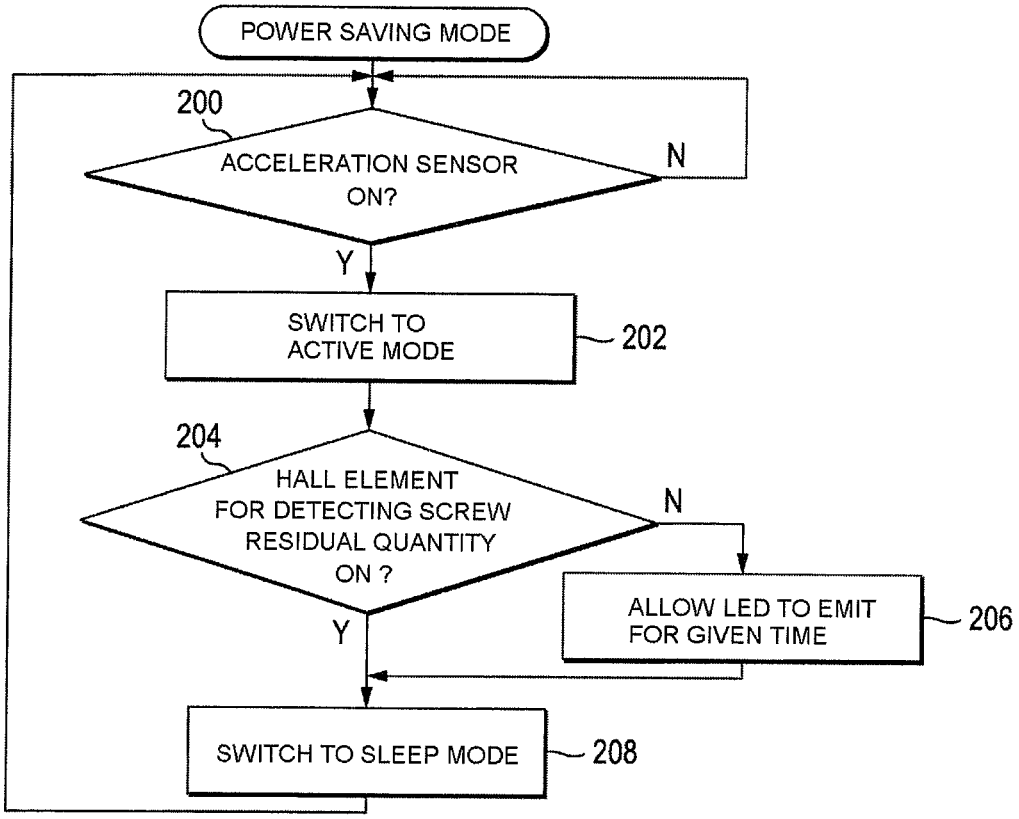
FIG. 17 is a flow chart of the power saving mode of the screw striking machine shown in FIG. 1.
Figure 18:
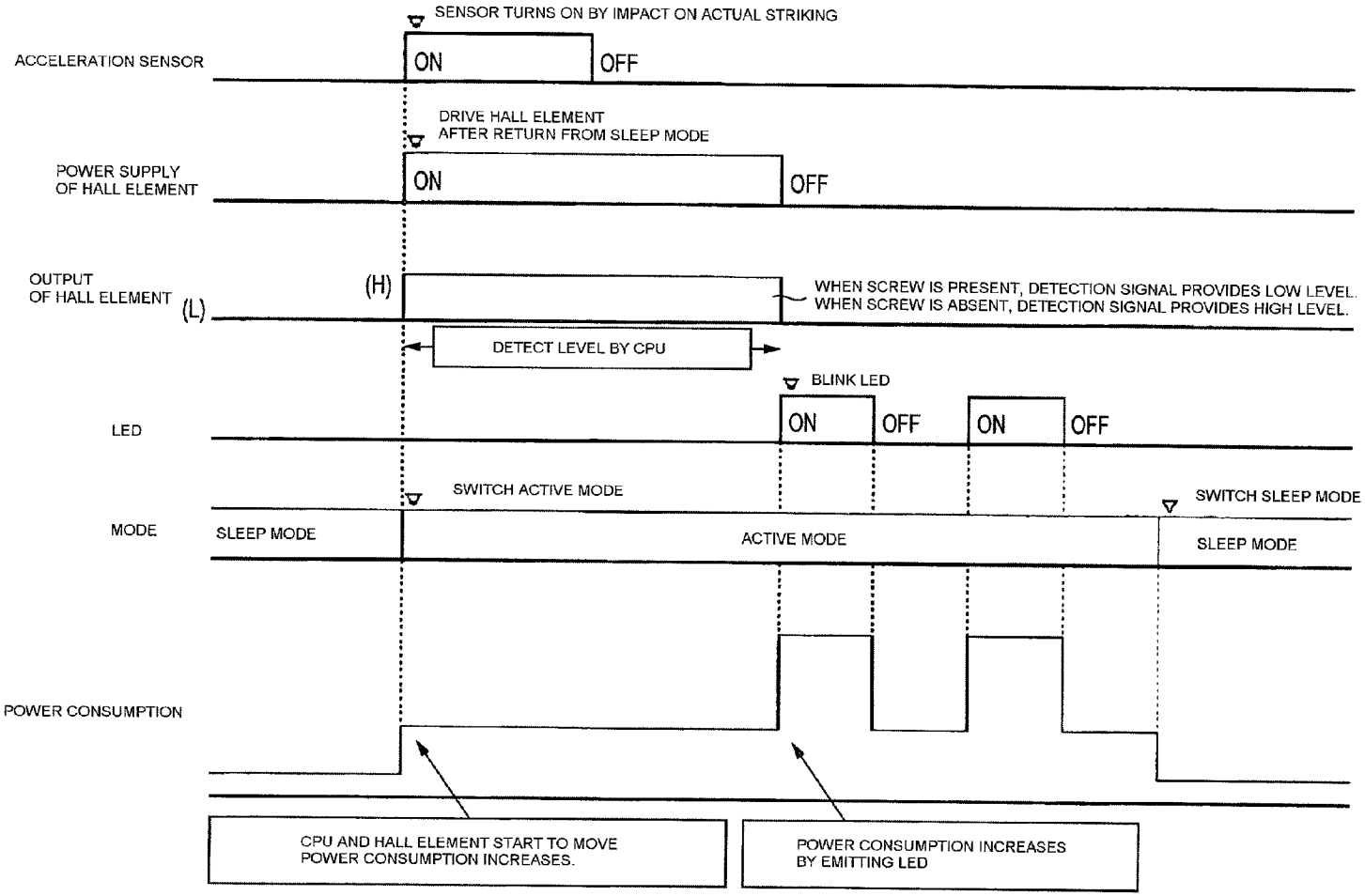
FIG. 18 is a timing chart of the power saving mode shown in FIG. 17.

In Step 200 shown in FIG. 17, the CPU 90 checks whether the acceleration sensor 48 shown in FIG. 4 is on or not (see FIG. 18). That is, the acceleration sensor 48 consisting of a piezoelectric element generates a voltage (an on signal) according to the impacts caused by the ejection of the screw W from the screw striking machine 10.

When this on signal is sent to the CPU 90, that is, when yes in Step 200, in Step 202, the CPU 90 switches the mode from a sleep (wait) mode over to an active (working) mode (see FIG. 18). Here, the sleep mode is a power saving mode in which power consumption is small. On the other hand, the active mode is a mode in which normal processing can be executed.

The normal processing includes: processing to detect the residual quantity of the screws W; alarm processing to emit a warning light, generate a warning sound, generate warning vibrations and display a warning; and, processing to count the number of screws W which have been struck. Also, in the normal processing, there is also included processing in which, when the residual quantity of the screws W is a given quantity or less, after the alarm processing is executed for a given time, the mode is returned to the sleep mode.

Here, since the impacts caused by the above-mentioned striking mechanism are given two times correspondingly to the forward and backward operations of the driver bit 12 shown in FIG. 3, when the detection signal from the acceleration sensor 48 is given twice, the CPU 90 determines that a screw W has been ejected. Also, when no in Step 200, that is, when the screw W is not struck actually, the CPU 90 waits for the actual striking of the screw W.

After transition to the active mode, in Step 204, the CPU 90 checks whether a detect signal from the Hall element 46 for detecting the residual quantity of screws is on or not. For example, as shown in FIGS. 9 and 10, in the case that the screw W is not present on the guide portion 30, that is, in the case that the residual quantity of screws W is small, the detecting lever 36 rotates to the vicinity of the cover 28 to thereby separate the magnet 42 and Hall element 46 from each other, so that the detection signal from the Hall element 46 becomes off (in FIG. 18, a high level signal H).

Thus, since Step 204 is determined to provide no, in Step 206, the CPU 90 allows the LED 50 shown in FIGS. 1 to 3 to emit a light blinkingly for a given time (see FIG. 13). Here, in Step 206, as described above (Step 102), the light emitting pattern of the LED 50 can also be changed according to the number of screws remaining (see Steps 106, 110, 114, 120 and 122).

On the other hand, as shown in FIGS. 6 and 7, in the case that the detecting lever 36 detects the screws W, the magnet 42 is allowed to face the Hall element 46, so that the signal from the Hall element 46 becomes on (in FIG. 18, a low level signal L). Thus, Step 204 is determined to provide yes.

In the case that Step 204 provides yes, or after end of the processing of Step 206, the active mode is switched (returned) to the sleep mode (see FIG. 18). Here, after execution of the processing of Step 208, the processing goes back to Step 200.

According to the present embodiment, as shown in FIG. 18, since the power is consumed only in the necessary situations such as the screw W residual quantity detecting processing and alarm processing, when compared with a case in which the active mode is always in operation, the power consumption of the electronic parts can be reduced greatly. That is, according to the present embodiment, in the case that the ejection of the screw W is detected, the sleep mode is switched to the active mode and, after execution of the normal processing, the active mode is returned to the sleep mode, whereby a power supply part such as a battery small in size and light in weight can be mounted on the screw striking machine 10.

Therefore, according to the present embodiment, since the weights of the screw residual quantity detecting mechanism S and LED 50, which are electronic devices for prevention of striking of a blank screw, can be controlled down to the necessary minimum value, it is possible to provide a screw striking machine 10 which is quite easy to use. Specifically, while the weight of the present screw striking machine 10 can be set substantially equal to that of a conventionally existing screw striking machine and the same exterior parts as conventional exterior parts can be used, the above-mentioned electronic devices for prevention of the above-mentioned blank screw striking can be mounted on the present screw striking machine 10.

Here, according to the present embodiment, since the residual quantity of the screws W is detected, the presence or absence of the screws W can be easily recognized without striking the screws W actually. That is, according to the present embodiment, since the striking of the blank screw can be prevented, the member to be tightened can be prevented against damage. Also, the flows (see FIG. 17) of the respective programs described above in the present embodiment are just an example, and thus they can be properly changed without departing from the subject matter of the invention. Further, according to the present embodiment, the repair history data may also be stored into the RAM 94 (see FIG. 11) serving as a memory through the input/output portion 96 shown in FIG. 13.

<Second Exemplary Embodiment>

Now, description will be given below of a control circuit used in a screw striking machine according to a second exemplary embodiment of the invention with reference to FIG. 19. According to the present embodiment, there is employed a structure in which there are provided an OR circuit and a semiconductor switch and the power is supplied to the CPU according to an on signal given from an acceleration sensor serving as a part of a screw ejection detecting portion.

Figure 19:
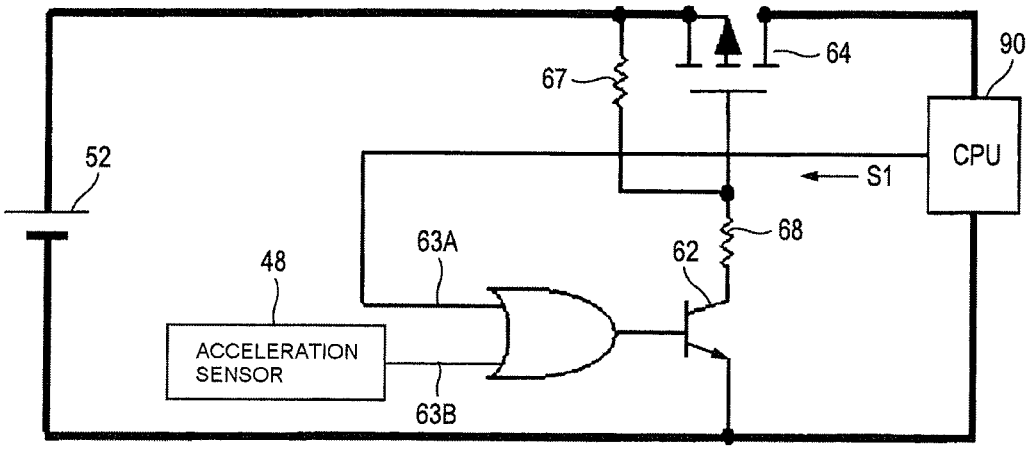
FIG. 19 is a control circuit diagram of a screw striking machine according to a second exemplary embodiment of the invention.
Figure 20:
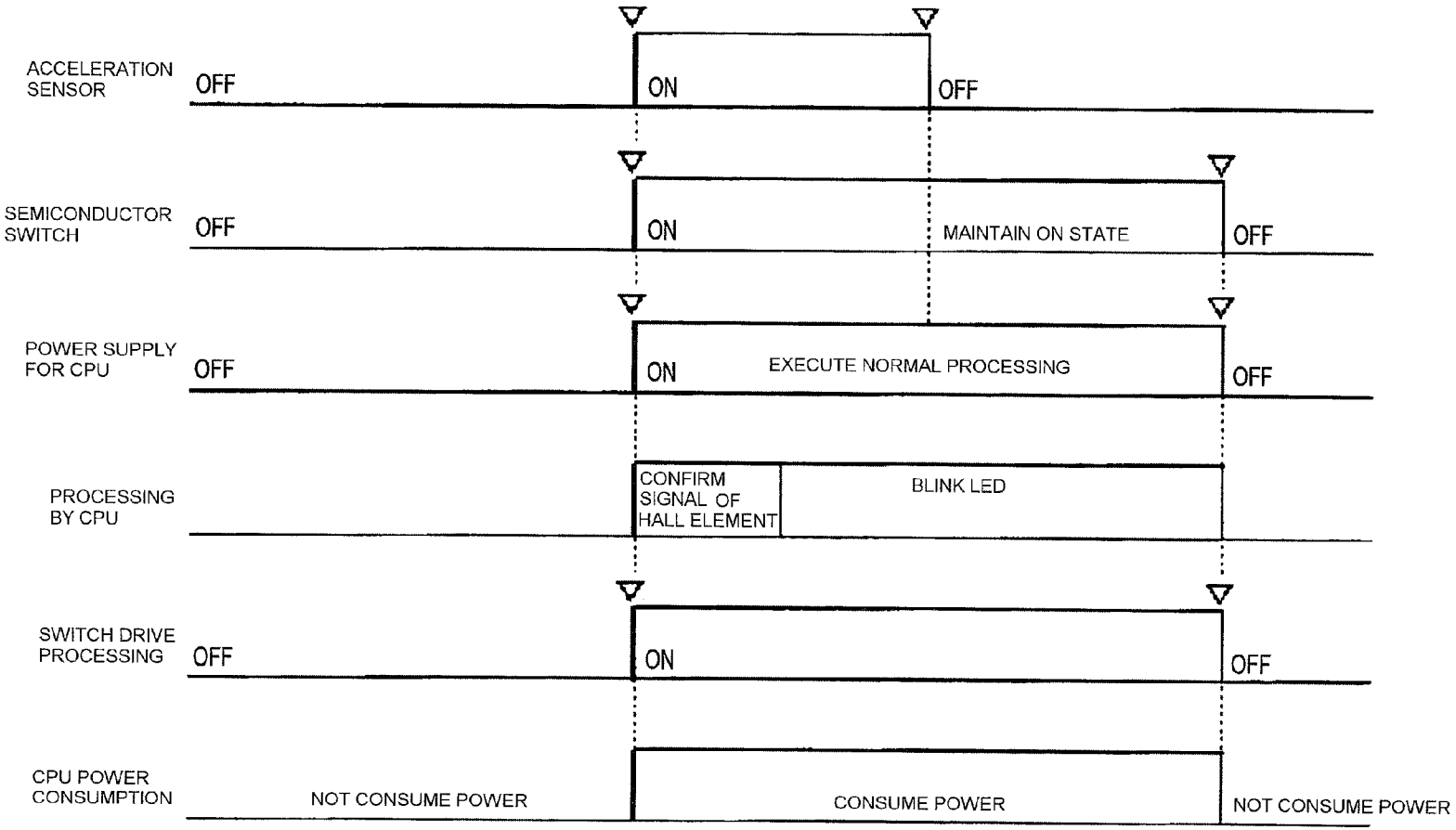
FIG. 20 is a timing chart of the screw striking machine shown in FIG. 19.
Figure 21:
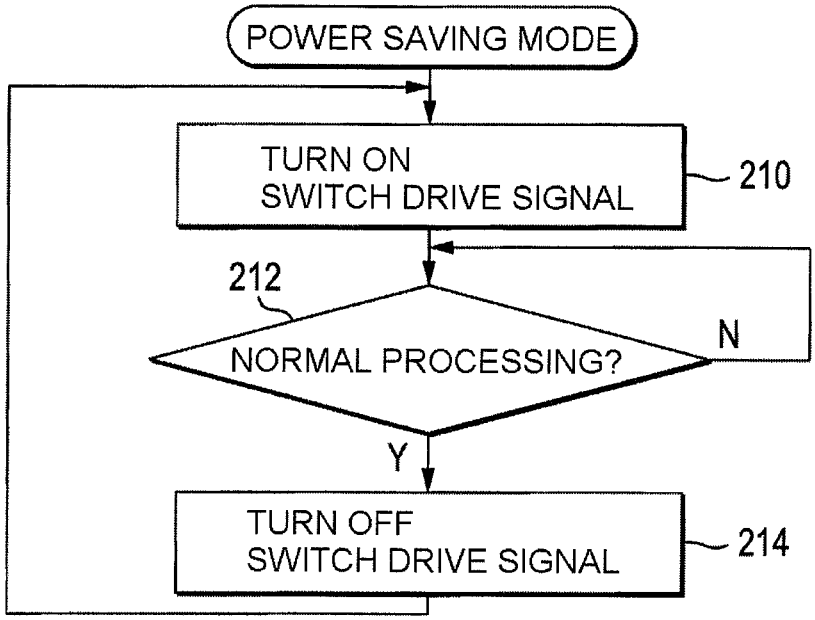
FIG. 21 is a flow chart of a power saving mode shown in FIG. 20.

Here, to the circuit diagram shown in FIG. 19, there is connected the LED 50 shown in FIG. 13 (in FIG. 19, which is not shown). Also, FIG. 20 shows a timing chart according to the present embodiment, and FIG. 21 is a flow chart of a power saving mode according to the present embodiment. Further, the same parts as in the first exemplary embodiment are given the same designations.

As shown in FIG. 19, the CPU 90 is connected to a battery 52 to thereby constitute a power supply circuit. The CPU 90 is also connected to the input terminal 63A of an OR circuit 62, while an acceleration sensor 48 is connected to the input terminal 63B of the OR circuit 62. Here, the OR circuit 62 is constituted of a circuit which uses a diode and an NPN transistor.

Also, between the battery 52 and CPU 90, there is connected an FET switch 64 made of a semiconductor switch. Here, between the FET switch 64 and battery 52, there is connected a resistance 67; and, between the FET 64 and OR circuit 62, there is connected a resistance 68.

And, since, when a screw is struck actually and the acceleration sensor 48 becomes on (see FIG. 20), a current (an on signal) is allowed to flow to the input terminal 63B of the OR circuit 62, the OR circuit 62 is put into conduction. And, the FET switch 64 is switched from off to on, whereby a voltage is applied to the CPU 90.

After then, as shown in FIG. 20, even in the case that the acceleration sensor 48 is turned from on to off, it is necessary to continue the normal processing (see FIG. 15) such as processing to confirm the signal of the Hall element 46 (see FIG. 4) and processing to blink the LED 50 (see FIG. 1). For this purpose, the CPU 90 outputs a switch drive signal S1 to the input terminal 63A of the OR circuit 62, whereby power can be supplied to the CPU 90. That is, the switch drive signal S1 is a signal which is used to keep the FET switch 64 on.

Next, description will be given below of processing to be executed in the power saving mode with reference to a flow chart shown in FIG. 21. It is assumed that, before start of the present flow chart, the above-mentioned acceleration sensor 48 is turned on and the power is supplied to the CPU 90. Here, before the power is supplied to the CPU 90, the screw striking machine is held in the same state as the sleep mode in the first exemplary embodiment; and, after supplying the power, the screw striking machine is put into the same state as the active mode in the first exemplary embodiment (see FIG. 20).

In Step 210 shown in FIG. 21, the CPU 90 allows the switch drive signal S1 to turn on and outputs such on signal to the input terminal 63A of the OR circuit 62. The CPU 90, in Step 212, checks whether the above-mentioned normal processing is ended or not. When Step 212 shows yes, in Step 214, the switch drive signal S1 is turned off, whereby the OR circuit 62 and FET switch 64 are respectively turned off.

Thus, the supply of the power to the CPU 90 is caused to stop and, as shown in FIG. 20, the power consumption of the CPU 90 and the like reduces down to zero. That is, the present screw striking machine is switched into the same state as the sleep mode in the first exemplary embodiment. Here, Step 212 is continued until the normal processing is ended. Therefore, in the present embodiment, according to the switch drive signal S1 of the CPU 90, the screw striking machine can be switched to the power saving mode.

Figure 22:
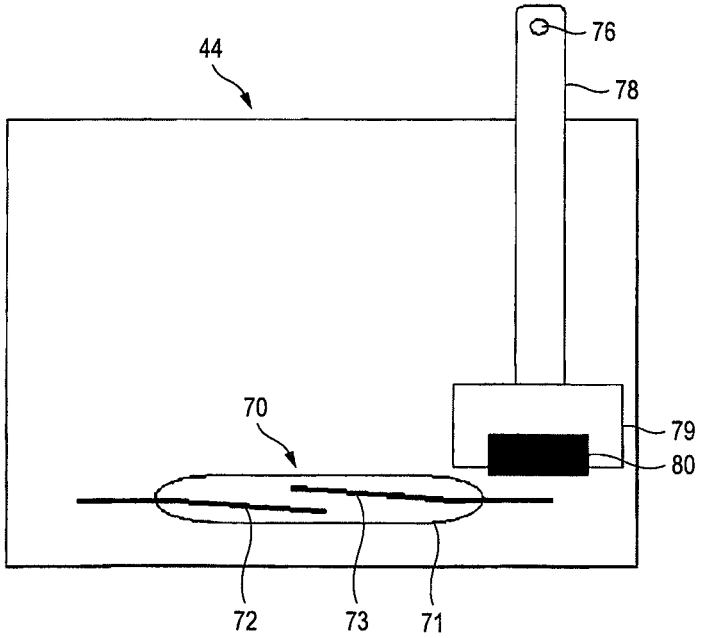
FIG. 22 is a schematic view of a reed switch having another injection detecting mechanism.
Figure 23:
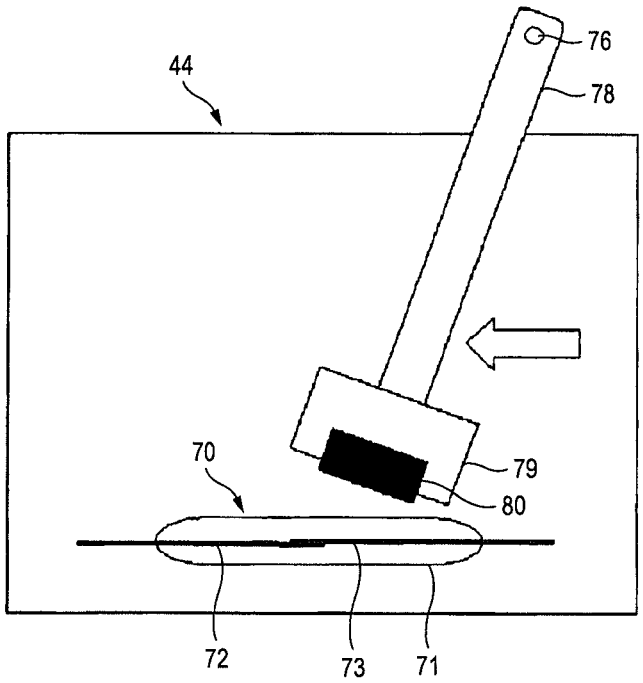

Here, according to the present embodiment, instead of the acceleration sensor, an ejection detecting structure constituted of a reed switch (a magnetic sensitive switch) 70 and a magnet 80 shown in FIGS. 22 and 23 may also be disposed on the circuit substrate 44. To structure the reed switch 70, a pair of electrodes 72 and 73 may be disposed opposed to each other within a glass tube 71 and an inert gas such as a nitrogen gas may be charged into the glass tube 71. And, the reed switch 70 is structured in such a manner that, as shown in FIG. 23, the paired electrodes 72 and 73 can be contacted with each other due to a magnetic field applied from outside to thereby close the circuit. Here, the reed switch 70 is further structured in the following manner. That is, even in the case that the paired electrodes 72 and 73 are contacted with each other, the reed switch 70 consumes only a small amount of power and, when the two electrodes are separated from each other, the reed switch 70 does not consume power at all.

As shown in FIG. 22, the magnet 80 is fixed to the leading end 79 of a pendulum 78, while the base end of the pendulum 78 is fixed to a support shaft 76. And, the pendulum 78 is disposed in such a manner that it can be vibrated about the support shaft 76 (can be rotated over a given angular range) due to an impact given when the screw is struck actually and, as shown in FIG. 23, when the pendulum 78 is vibrated, it approaches the reed switch 70. Owing to this, in the present embodiment as well, when the screw is struck actually, the reed switch 70 is turned on, whereby the CPU 90 can determine or count the actual striking of the screw. That is, according to the present invention, there can be employed any electronic device such as an acceleration sensor and a reed switch, provided that it is capable of detecting the ejection of the fastener.

<Third Exemplary Embodiment>

Now, description will be given below of a detecting box 60 according to a third exemplary embodiment of the invention with reference to FIGS. 24 and 25. Here, the same parts of the present embodiment as the first exemplary embodiment are given the same designations. This detecting box 60 is an example in which, differently from the first exemplary embodiment, there is used an LED 50 in addition to the detecting lever 36.

Figure 24:
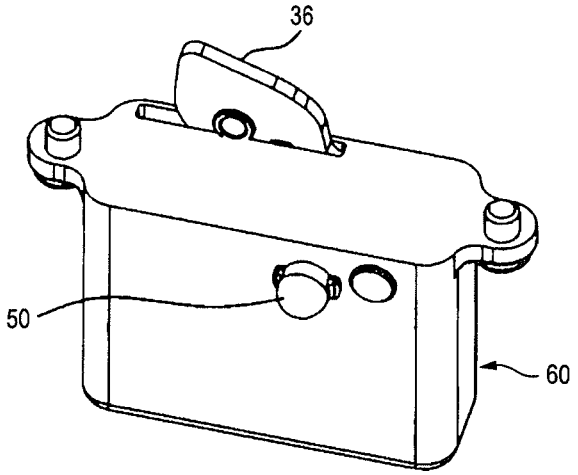
FIG. 24 is a perspective view of the whole of a detecting box according to a third exemplary embodiment of the invention.
Figure 25:
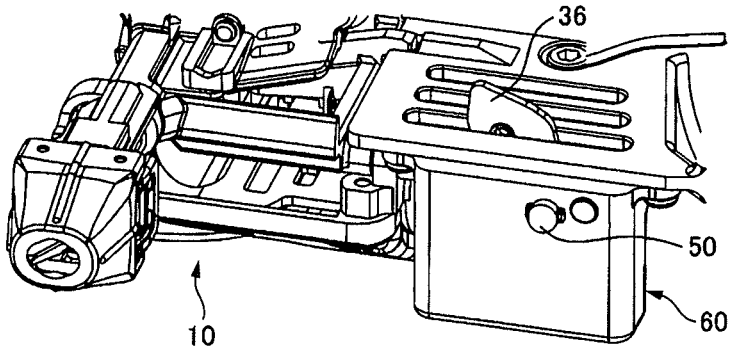
FIG. 25 is a perspective view of the detecting box shown in FIG. 24, showing a state in which it is post-mounted on an existing screw striking machine.

The detecting box 60 according to the present embodiment, as shown in FIG. 24, is an example in which a detecting lever 36 is also mounted in the interior thereof and also which can be post-mounted onto a conventionally existing screw striking machine. That is, according to the present embodiment, multiple detecting parts such as the detecting lever 36 and LED 50 are formed as assembled finished unit products (assemblies). Therefore, according to the present embodiment, since the detecting box 60 is structured in such a manner that it can be easily mounted and removed, various kinds of maintenance and replacement can be facilitated.

Also, the mounting position of the detecting box 60 may be changed arbitrarily to any other position (on the delivery passage of the screws, provided that it is capable of detecting the residual quantity of the screws W. For example, the detecting box 60 may also be disposed on the ejection side (the position shown in FIG. 20) of the screws W. The other structures and operation effects of the present embodiment are similar to those of the first exemplary embodiment and thus the detailed description thereof is omitted here.

<Other Modifications>

According to the invention, power may also be generated by the air motor 18 to thereby provide auxiliary power. Also, a main switch may be provided on the circuit and may be turned on or off by an operator.

Also, the LED 50 according to the embodiments may also be made of a high-brightness LED and a change-over switch may also be provided. In this case, an illuminating function can be fulfilled in a necessary case such as an operation in a dark place.

Also, the warning method can be changed arbitrarily. For example, according to the embodiments, the LED 50 is caused to blink for a given time and, the smaller the number of remaining screws is, the faster the LED 50 is caused to blink according to the light emitting patterns. However, for example, the light emitting color of the LED may also be changed according to the number of remaining screws (from yellow to red). Further, a warning may also be given at the arbitrary number of remaining screws, or there may also be disposed a speaker/vibrator device and thus a warning may be given using buzzer sounds/vibrations which tell the number of remaining screws.

Also, according to the invention, together with the screw residual quantity detecting mechanism S, in order to facilitate the recognition of the residual quantity of the screws W, for example, the magazine 26 may be disposed at a position easy to observe. Further, according to the invention, the total number of screws W struck may be counted using the acceleration sensor 48 or the like and, according to such counted number, the maintenance timing may be informed. Or, by detecting the voltage of the battery 52, the replacing timing of the battery may also be warned.

As the structure for detecting the residual quantity of the screws W, besides the above-mentioned structure in which the magnet 42 and Hall element 46 are used in combination, there may also be used a structure for detecting the weight of the screws W. For example, there may be used a structure in which a microswitch of an on/off type or an off/on type is depressed by a distortion sensor/detecting lever 36 for detecting a deflection amount, or a structure in which the arbitrary number of remaining screws is detected, or a structure in which the shape of the connecting belt WN is changed and the thus changed shape is detected.

Also, although the embodiments illustrates an example in which the other end of the conductor 56 is connected to the connector 58A, the conductor 56 may also be soldered directly to the circuit substrate 44. That is, the conductor 56 may be connected according to any method, provided that it can connect the battery 52 and circuit substrate 44.

Further, although the illustrated embodiment is an example in which the battery 52 is connected through the conductor 56 and is stored into the storage portion 35 in a floating state, the battery 52 may also be mounted on the circuit substrate 44, the whole of the circuit substrate 44 may be wrapped with a buffer member such as sponge and may be stored into the tool main body.

Although the illustrate embodiment is an example in which the fastener successively feeding tool of a hand-held type is used as a screw striking machine, the fastener successively feeding tool of a hand-held type according to the invention can also be applied to a tool which successively feeds fasteners such as a nail and a staple. Also, according to the illustrated embodiment, there is illustrated a hand-held type fastener successively feeding tool of a compressed air drive type. However, since the present invention is able to save the power consumption, it can also be applied to a hand-held tool of an electric type. Further, in the illustrated embodiment, the fasteners, to which the invention is applied, are illustrated in such a manner that they are connected together by a connecting belt such as a connecting wire. However, the invention can also be applied to a hand-held tool structured such that multiple fasteners not connected together by the connecting belt are ejected from the hand-held tool using a successively feeding device. Also, the mounting structure for mounting the thin-film-shaped electronic parts according to the invention can provide stable performance with a simple structure and can be reduced in size and weight at a low cost; and, therefore, the present mounting structure can also be applied to a hand-held tool of an electric type.

Description has been given heretofore specifically of the invention with reference to the specific embodiments thereof. However, it is obvious to those skilled in the art that various changes and modifications are possible without departing from the spirit and scope of the invention.

The present application is based on the Japanese Patent Application (Japanese Patent Application No. 2008-026991) filed on Feb. 6, 2008, Japanese Patent Application (Japanese Patent Application No. 2008-026992) filed on Feb. 6, 2008, Japanese Patent Application (Japanese Patent Application No. 2008-026993) filed on Feb. 6, 2008 and thus the contents thereof are incorporated herein for reference.

Industrial Applicability:

The present invention can be applied to a hand-held tool which successively feeds multiple fasteners. Also, the invention can be applied to a structure for connecting an electronic part heavy in weight to a circuit substrate, and a structure for disposing a thin-film-shaped electronic part on a circuit substrate.

The invention claimed is:

1. A hand-held tool in which multiple fasteners are successively fed, the hand-held tool comprising:

a trigger, wherein a fastener is ejected from a nose portion when the trigger is operated;

a contact member disposed slidably with respect to the nose portion, wherein an operation of the trigger is effective only when the contact member is pressed against a member to which the fastener is driven;

an ejection detecting portion configured to detect an ejection of the fasteners;

a fastener residual quantity detecting mechanism configured to detect a residual quantity of the fasteners and configured to display a light emitting pattern corresponding to the residual quantity of the fasteners such that a blinking interval of the light emitting pattern changes with a change in the residual quantity of the fasteners; and a control portion configured to switch from a power saving wait mode of small power consumption to an active mode of executing normal processing in response to the ejection detecting portion detecting the ejection of the fasteners, and configured to switch from the active mode to the wait mode in response to the residual quantity of the fasteners being a given quantity or less.

2. The hand-held tool according to claim 1, wherein the ejection detecting portion includes a sensor with a piezoelectric member.

3. The hand-held tool according to claim 1, wherein a detection of the residual quantity of the fasteners by the fastener residual quantity detecting mechanism is executed in the active mode.

4. The hand-held tool according to claim 1, wherein the residual quantity detecting mechanism changes the light emitting pattern so that the blinking of the light emitting pattern continues constantly until a new fastener is loaded when the fasteners run out.

5. The hand-held tool according to claim 1, wherein the residual quantity detecting mechanism changes the light emitting pattern so that the blinking of the light emitting pattern continues constantly for a given time when the fasteners run out.

6. A power saving method of a hand-held tool in which multiple fasteners are successively fed, the power saving method comprising:

detecting an ejection of the fastener by an ejection detecting portion;

detecting a residual quantity of the fasteners with a fastener residual quantity detecting mechanism and displaying a light emitting pattern corresponding to the residual quantity of the fasteners such that a blinking interval of the light emitting pattern changes with a change in the residual quantity of the fasteners;

switching from a power saving wait mode of small power consumption to an active mode of executing normal processing, in response to the ejection detection portion detecting the ejection of the fasteners; and switching from the active mode to the wait mode in response to a residual quantity of the fasteners being a given quantity or less, wherein the fastener is ejected when a trigger is operated, and an operation of the trigger is effective only when a contact member is pressed against a member to which the fastener is driven.

7. The method according to claim 6, further comprising:

detecting a piezoelectric effect of a sensor, wherein the ejection of the fasteners is detected when the piezoelectric effect is detected.

8. A fastener residual quantity detecting mechanism of a hand-held tool in which multiple fasteners are successively fed, the mechanism comprising:

a residual quantity detecting portion for detecting the residual quantity of fasteners, the residual quantity detection portion configured to display a light emitting pattern corresponding to the residual quantity of the fasteners such that a blinking interval of the light emitting pattern changes with a change in the residual quantity of the fasteners, wherein the residual quantity detecting portion includes a detecting lever, a magnet, and a Hall element, wherein when the detecting lever detects the presence of fasteners, the Hall element faces the magnet, and wherein when the detecting lever detects the absence of fasteners, the Hall element is spring-biased away from the magnet.

9. The fastener residual quantity detecting mechanism according to claim 8, further comprising:

a counter portion configured to count the residual quantity of the fasteners.

10. The fastener residual quantity detecting mechanism according to claim 8, wherein multiple detecting parts for detecting the residual quantity of the fasteners are formed as an assembled/completed single unit product and removably mounted on a main body of the hand-held tool.

11. A fastener residual quantity detecting method of a hand-held tool in which multiple fasteners are successively fed, the method comprising:

disposing a Hall element such that when a detecting lever detects the presence of fasteners, the Hall element faces a magnet, and when the detecting lever detects the absence of fasteners, the Hall element is spring-biased away from the magnet, detecting the residual quantity of the fasteners, and displaying a light emitting pattern corresponding to the residual quantity of the fasteners such that a blinking interval of the light emitting pattern changes with a change in the residual quantity of the fasteners.

* * * * *